United States Patent [19]

Stenkvist

[11] 4,038,483

[45] July 26, 1977

[54] MEANS FOR DIRECT CURRENT ARC FURNACES

[75] Inventor: Sven Einar Stenkvist, Vasteras, Sweden

[73] Assignee: ASEA Aktiebolag, Vasteras, Sweden

[21] Appl. No.: 647,215

[22] Filed: Jan. 7, 1976

[30] Foreign Application Priority Data

Jan. 14, 1975 Sweden ..... 75003442

[51] Int. Cl.[2] ..... H05B 7/20

[52] U.S. Cl. ..... 13/11

[58] Field of Search ..... 13/9, 11

[56] References Cited

U.S. PATENT DOCUMENTS

| | | | |
|---|---|---|---|
| 1,404,734 | 1/1922 | Bennett | 13/11 UX |
| 1,562,825 | 11/1925 | Evreynoff | 13/11 |
| 3,835,230 | 9/1974 | Valchev | 13/9 |

*Primary Examiner*—R. N. Envall, Jr.

*Attorney, Agent, or Firm*—Kenyon & Kenyon, Reilly, Carr & Chapin

[57] ABSTRACT

A DC electric arc furnace having laterally offset hearth and arcing electrodes, has the arcing electric power for one of the electrodes carried by a conductor arranged with respect to the furnace hearth to provide an electric field within the furnace and which bucks the field created by the offset electrodes so that the arc formed within the furnace is vertically oriented.

8 Claims, 3 Drawing Figures

MEANS FOR DIRECT CURRENT ARC FURNACES

Figure 1:
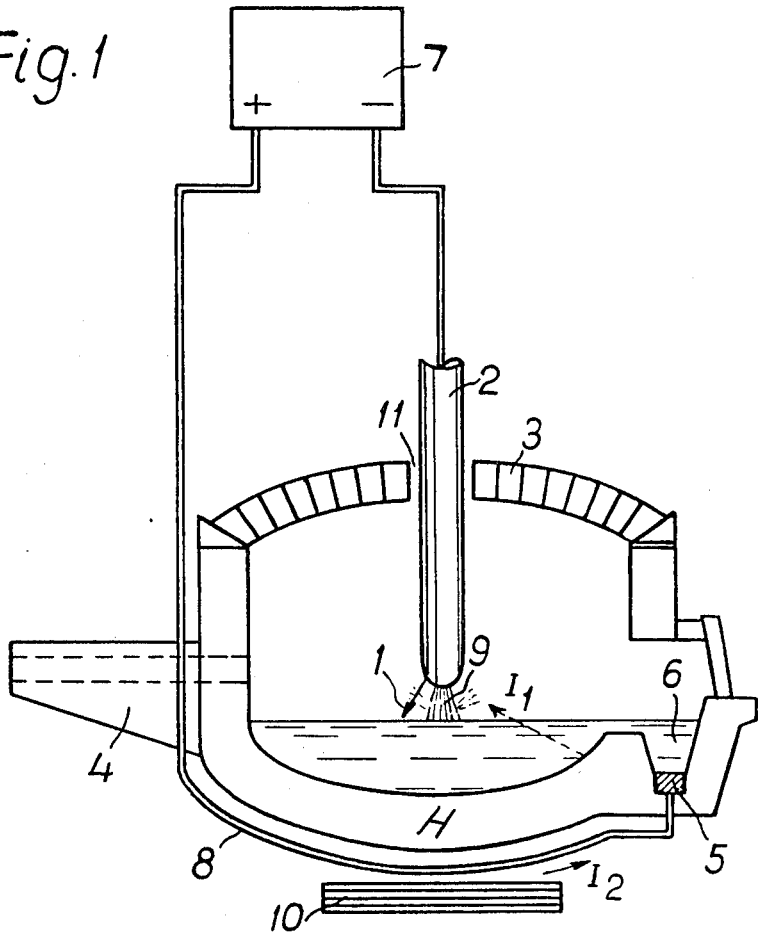

The present invention relates to arc furnaces supplied with direct current, comprising a furnace vessel having a non-magnetic hearth and bottom and at least one melt or hearth arcing electrode (anode) which is (cathode) and at least one contact electrode laterally offset from the arcing electrode.

A furnace of the above kind is disclosed in U.S. Stenkvist patent application Ser. No. 594,739 assigned to the assignee of the present invention. In this direct current arc furnace iron cores are provided with magnetizing windings supplied with direct current or low-frequency alternating current, a magnetic field thus being introduced in the furnace which controls the arc in a desired manner in dependence on the direction and location of the field. In an embodiment according to said application, the cores with magnetizing windings are placed below the furnace bottom, which is made of non-magnetic material, the cores being oriented in such a way that the field generated is disposed substantially perpendicularly to the arc and the direction in which because of the laterally offset electrodes the arc would tend to become obliquely positioned without the use of control magnets. The magnetic law of forces (Biot and Savart's law) is utilized, that is, $F = B \times I$, and thus it is possible to achieve a resulting force $F$ in a direction which counteracts the tendency to obliquity of the arc. Thus, this is an arrangement with magnet coils and cores to counteract obliquity of the arc. Thus, this is an arrangement with magnet coils and cores to counteract obliquity of the arc in a direct current arc furnace with asymmetrical current feed in the charge due to a hearth electrode being laterally offset from an arcing electrode.

The present application concerns an improvement on the foregoing and also in this case the object is to counteract obliquity of the arc. The improvement is characterized in that at least one current conductor, a compensating conductor, is connected in series with the arc current and is arranged below the furnace vessel in such a way that the current through this conductor will pass in a direction substantially opposite to the direction in which the current flows through the melt charge in the furnace. In this way the advantage is obtained, as will be clear from the following, that the compensation of the obliquity of the arc will become self-regulating at different arc currents.

In a preferred embodiment of the invention there are also placed additional control magnets below the furnace vessel, for example multipolar electro magnets, in order to rotate the arc. This will cause the wear on the furnace to be evenly distributed and certain extra worn parts to be avoided. The control magnet or magnets should suitably be fed with a low-frequency alternating current, usually with a frequency of below 25 Hz suitably 0.1 to 10 Hz.

In another preferred embodiment of the invention there are arranged electric connection leads to the compensating conductor, which leads are drawn completely or partly around the furnace vessel, suitably at a certain level above the bottom place, and thereafter connected to the compensating conductor. This allows the degree of compensation to be increased, which may often be necessary where the distance between the conductor and the arc is larger, that is, in larger furnaces.

Figure 2:
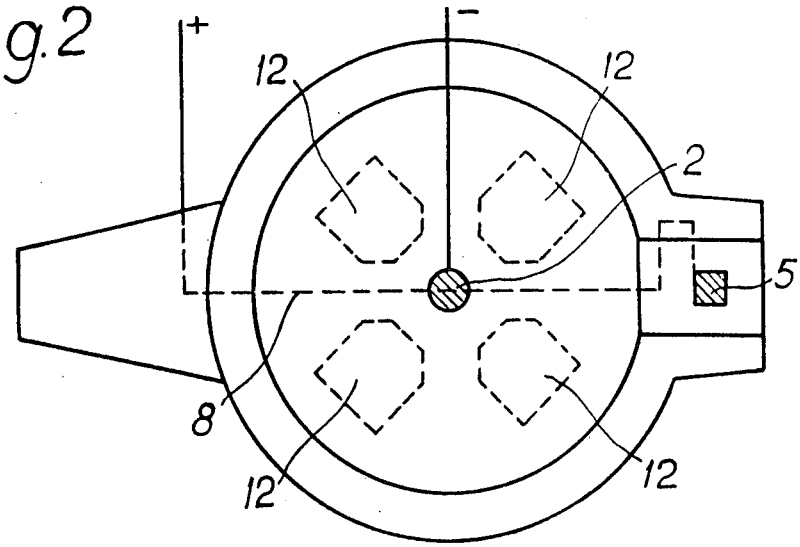

The furnace according to the invention is illustrated in more detail in the accompanying figures, of which FIG. 1 is a vertical section, and FIG. 2 a schematic showing of the same furnace seen from above and provided with control magnets.

Figure 3:
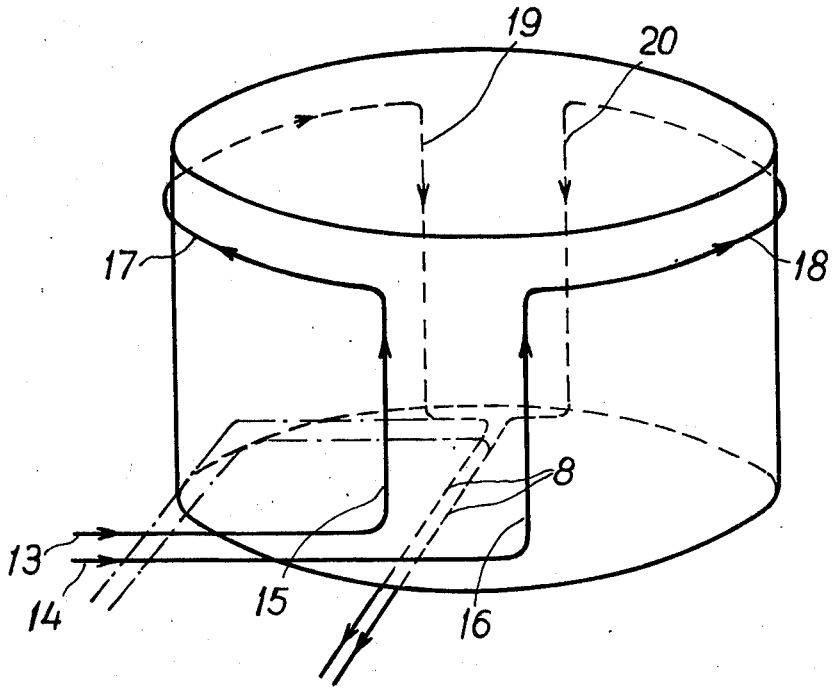

FIG. 3 is a further development of the invention with the special construction of the electric connection leads.

FIG. 1 shows a direct current arc furnace having a non-magnetic side wall and bottom and provided with a cathode arcing electrode 2 (possibly more cathodes electrodes may be used), and the cathode electrode is suitably made of graphite or in the form of a Soderberg electrode. The electrode 2 is inserted through an opening in the furnace roof 3 and the furnace is as usual tiltable and provided with a tapping spout 4. Like the furnace according to the previously mentioned patent application, this furnace is provided with a laterally offset hearth electrode 5 which, together with the melt or charge 6, constitutes the anode. In a non-compensated connection, the current through the charge or melt in the hearth H from the hearth electorde 5 to the cathode electrode 2 (see at the arrow $I_1$) will cause a tendency for an oblique arc to form according to arrow 1 in FIG. 1. According to the invention, the current is now conducted from the positive pole of the DC current source 7, below the furnace vessel at 8 in such a direction that the current $I_2$ in the compensating conductors which is series-connected with the cathode electrode will flow in the conductor below the vessel in such a direction that the field therefrom in the charge or melt will compensate the field from the normal power current through the charge, and the arc will become substantially vertical (see at 9).The arc current will thus be connected through the conductor 8 in series with the main circuit, with the arc 9. As mentioned, this will result in a self-regulting compensation of the obliquity of the arc at different arc currents. Such a compensating conductor can be formed of only one conductor or it may be formed as a coil with a few turns, which should be disposed so that a compensation of the obliquity of the arc is obtained and so that the return conductor at the coil will not affect the arc. The furnace vessel is provided with a non-magnetic bottom, and numeral 10 indicates an iron core located below the conductor 8.

The strength of the compensating magnetic field from the conductor 8, or the coil, may be adjusted in many ways. It is thus possible to locate the conductor 8 and/or the core 10 nearer or farther away from the furance bottom. The dimensions of the core 10 can be varied and in some applications this core can be completely omitted. The core 10 can also be made in the form of two parts, located at either side of the conductor, and also other combinations of such a core division are possible, as well as variations of the distance from the conductor to the furnace bottom.

In FIG. 2 another embodiment of the invention is shown. In the same way as shown in FIG. 1, a conductor 8 is located in compensating direction below the furnace vessel, intended to compensate for the furnace current between the hearth electrode 5 and the cathode 2. As in the case according to FIG. 1, the hearth electrode 5 is placed to the side of the furnace vessel. A control magnet 12, in this case a four-pole core magnet, is placed below the furnace vessel, but of course another pole number of the magnet is possible. These control electromagnets are designed in the same way as in the previous patent application mentioned above, and they are suitably fed with low-frequency alternating current, preferably below 25 Hz and suitably from 0.1 to 10 Hz. In the same way as in the older embodiment, the four-pole core will rotate the arc around in the furnace, so that the wear of the furnace walls will be evenly distributed and the life of the furnace lining will be increased. At the same time there is obtained the counteracting or compensating effect, described connection with in FIG. 1 and the corresponding text, from the conductor 8 on an obliquity of the arc from the cathode 2, which would otherwise arise. The control poles are suitably provided with cores, here four-pole cores, and these cores can serve a double function, on the one hand as core in the control magnet 12, and on the other as core for the compensating conductor 8.

By successively switching in direct current control magnets, it is possible, of course, to obtain a similar rotation of the arc, and the pole number may of course be other than four.

When designing the compensating conductor in the form of a coil, at least one part of the coil should be placed in the same way as the conductor 8 in FIG. 1, and the return conductor for completion of the coil turn should then be placed so that this will not affect the arc.

There has been described above how the obliquity of the arc in a DC furnace, caused by the asymmetrical positioning of the hearth electrode, is counteracted by a current lead to the hearth electrode which is located below the furnace bottom in such a way that the direction of the current in this conductor is opposed to the direction of the current in the steel bath. The conductor has thus been located diametrically below the furnace bottom from the connection point at the hearth electrode to the opposite side of the furnace vessel. In certain cases it has proved to be desirable to be able to increase the degree of compensation further, for example, in the case of larger furnaces where the distance between the conductor and the arc is larger. The strength of the compensation can be expressed as the magnetic field strength of the arc in gauss per kA of conductor current. It can thus be mentioned that in one case 1.2 gauss per kA was reached, which proved to be sufficient, whereas in another case an undercompensation could be established at 0.9 gauss per kA. One way of increasing the degree of compensation is to place double coils of conductors below the furnace bottom, which, however, sometimes may be awkward because of the greatly increased length of the conductor with resultant increased losses. Furthermore, it may prove to be difficult to make room for double conductor coils below the furnace, but of course this is possible when using particular embodiments. However, there may be occasions when this is less suitable, and the means according to the below is one way of solving this problem, while at the same time achieving an increased degree of compensation. An increased degree of compensation without double coils and with a moderate increase in the conductor length can be achieved with an embodiment according to FIG. 3, that is, if the conductor, on to a position diametrically opposite to the hearth electrode where the compensating conductor starts, is located at the top of the furnace vessel. It is thus seen here how two conductors 13 and 14, emanating from the positive pole of the DC source, are drawn in the form of two vertical connecting conductors 15, 16, which thereafter change into leads 17, 18, drawn around the periphery of the furnace vessel and substantially horizontally. The two conductors 17 and 18 are locted on diametrically opposite parts of the furnace vessel and at the upper part of the furnace vessel, suitably near its upper edge. These conductors can suitably be made to be vertically movable and be connected to different connection points, not shown, on the vertical connecting conductors 15, 16. At their rear parts, seen in the figure, the leads are connected to vertical connecting conductors 19, 20, leading to the compensating conductors 8, and of course these may be provided with corresponding points of connection.

The leads 17, 18 change into the connecting conductors 19, 20 and therefrom into the above-mentioned compensating conductors 8, here two parallel conductors drawn in a manner shown above. The conductors indicated by dots and dashes in FIG. 3 show the comparison with the embodiments shown in FIGS. 1 and 2.

In this way a contribution is obtained to the compensating field from all conductor parts, and from the conductor located at the upper edge of the furnace vessel as well as from the vertical connecting conductors along the furnace vessel. As can be seen here, a conductor often consists of several parallel tubes and in order to avoid a rotation of the compensating field, they may be positioned symmetrically on either side of the furnace vessel as shown in FIG. 3. With this location of the conductor a compensating field of 1.7 gauss per kA has been measured, which should be more than enough.

It may sometimes be difficult to calculate in advance the required compensating field, and therefore the horizontal bent conductor part has been constructed so that it may be moved to different levels according to the above. Locating the horizontal, bent conductor part 17, 18 at a lower level will produce a decreased compensating field, but it may sometimes be convenient to be able to move the conductors in vertical direction, for example to avoid over-compensation, which would otherwise be obtained with too high a location of the conductor part 17, 18. The means according to the above can be varied in many ways within the scope of the following claims.

I claim:

1. A DC electric arc furnace comprising a furnace enclosure having a hearth for containing a melt, said hearth having a contact electrode for the melt, an arcing electrode positioned above the melt for forming an arc with the melt when placed in circuit therewith via said electrode, said arcing and contact electrodes being relatively offset in a horizontal direction so that the arc is normally angularly deflected with respect to a vertical direction, and means for applying a magnetic field to the arc so as to control its arcing direction, said furnace having a DC power source and means for electrically connecting said electrodes in series with said source to form through said melt, an electric power circuit powered by said source, said means being formed by said power circuit including at least one electric conductor positioned to form said magnetic field and which is in series connection with the balance of said power circuit.

2. The furnace of claim 1 in which said electric conductor extends below said hearth and the hearth is of nonmagnetic construction.

3. The furnace of claim 1 in which said electric conductor extends around the side wall of said enclosure and said side wall is non-magnetic.

4. The furnace of claim 2 in which said conductor is formed by two parallel conductors which extend under said hearth and then separately loop in opposite directions around the side of said enclosure, said side wall being non-magnetic.

5. The furnace of claim 4 in which said conductors loop around an upper portion of said side.

6. The furnace of claim 2 in which said electric conductor is formed into at least one coil convolution.

7. The furnace of claim 2 in which said electric conductor is provided with an iron core.

8. The furnace of claim 2 having multipole electromagnets positioned below said hearth with their poles arranged to cause said arc to rotate when said electromagnets are supplied with low frequency AC.

* * * * *

UNITED STATES PATENT OFFICE

CERTIFICATE OF CORRECTION

Patent No. 4,038,483 Dated July 26, 1977

Inventor(s) Sven Einar Stenkvist

It is certified that error appears in the above-identified patent and that said Letters Patent are hereby corrected as shown below:

Column 1, lines 29, 30 and 31, delete "Thus, this is an arrangement with magnet coils and cores to counteract obliquity of the arc."

Column 1, line 61, after "bottom" delete "place" and replace with --plane--.

Column 3, line 4, after "described" delete "connection with in" and replace with --in connection with--.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*